United States Patent [19]

Martin

[11] Patent Number: 5,033,521

[45] Date of Patent: Jul. 23, 1991

[54] CAP WITH COLLAPSIBLE FUNNEL

[76] Inventor: Gregory A. Martin, 7527 W. Turquoise Ave., Peoria, Ariz. 85345

[21] Appl. No.: 512,761

[22] Filed: Apr. 23, 1990

[51] Int. Cl.[5] ..... B65B 39/00

[52] U.S. Cl. ..... 141/337; 141/86; 141/88; 141/339; 141/341; 220/86.2; 220/85 SP

[58] Field of Search ..... 141/331, 337, 338, 339, 141/340, 341, 342, 86, 87, 88; 220/86.1, 85 SP, 85 F

[56] References Cited

U.S. PATENT DOCUMENTS

| | | | |
|---|---|---|---|
| 1,740,418 | 12/1929 | Donnelly | 141/337 |
| 4,058,995 | 11/1977 | Greaves | 70/431 |
| 4,112,984 | 9/1978 | Guglia et al. | 141/98 |
| 4,286,634 | 9/1981 | Wisner | 141/95 |
| 4,338,983 | 7/1982 | Hatcher | 141/331 |
| 4,515,245 | 5/1985 | Salmon | 184/105 |
| 4,531,245 | 7/1985 | Lowd et al. | 4/144.3 |
| 4,557,378 | 12/1985 | Klebold | 206/223 |
| 4,583,668 | 4/1986 | Maynard, Jr. | 222/529 |
| 4,600,125 | 7/1986 | Maynard, Jr. | 222/81 |
| 4,703,867 | 11/1987 | Schoenhard | 220/85 |
| 4,706,719 | 11/1987 | Eversdijk | 141/98 |
| 4,856,568 | 8/1989 | Murphy et al. | 141/337 |

*Primary Examiner*—Ernest G. Cusick

*Attorney, Agent, or Firm*—Don J. Flickinger; Jordan M. Meschkow

[57] ABSTRACT

An extendable cap for sealing a fluid inlet port having a holding plug which when removed, allows a telescoping funnel to be extended from a base section attached to the fluid inlet port. The extended telescoping funnel defines a fluid conduit through which a fluid may be guided into the fluid inlet port.

29 Claims, 3 Drawing Sheets

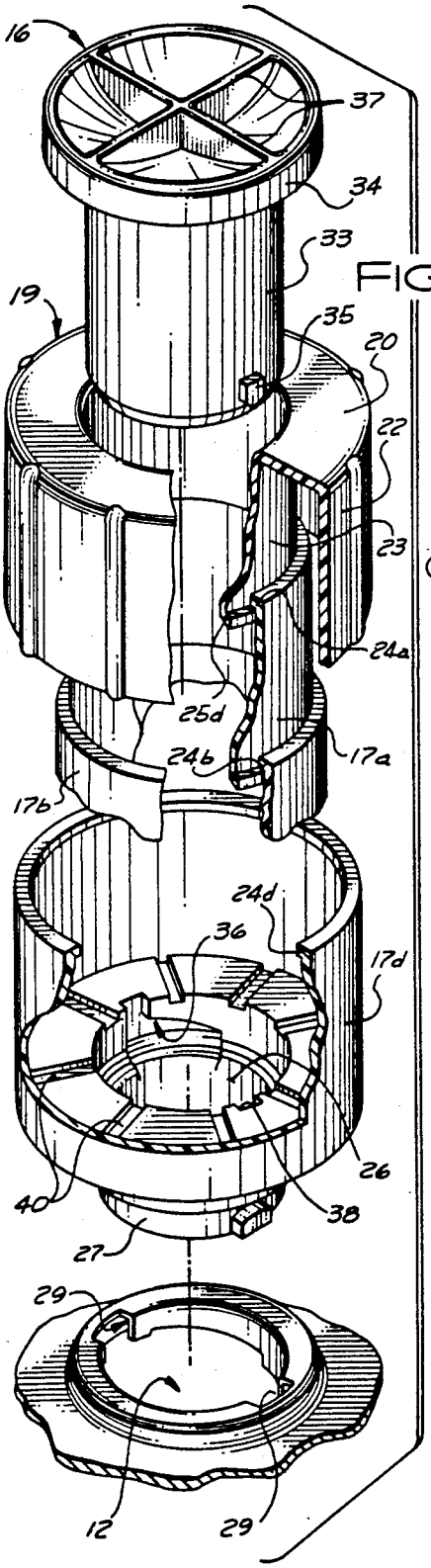
FIG. 8
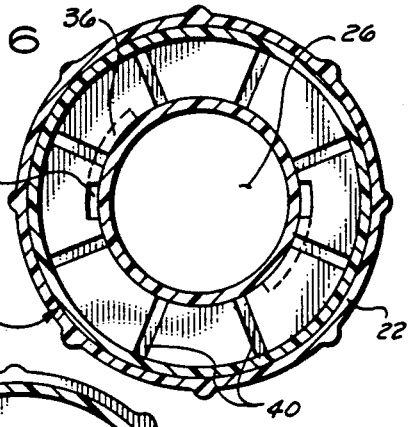
FIG. 6
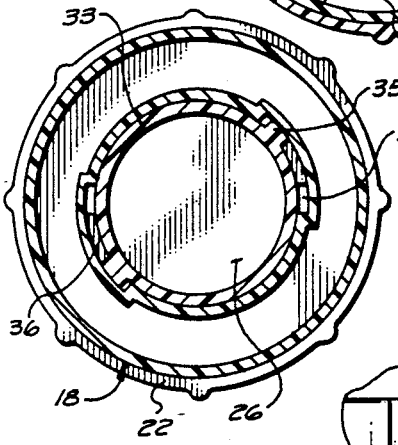
FIG. 7
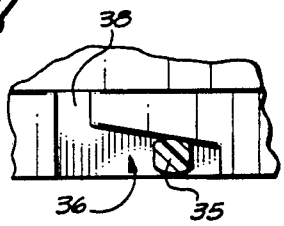
FIG. 9
FIG. 10
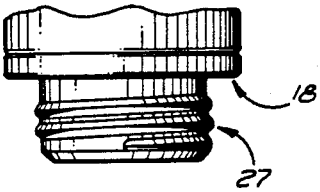
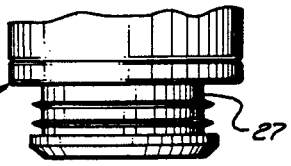
FIG. 11
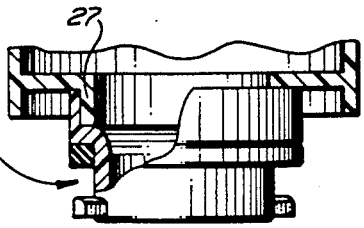
FIG. 12

CAP WITH COLLAPSIBLE FUNNEL

BACKGROUND OF THE INVENTION

1. Field of the Invention

This invention relates to devices for funnelling fluids. More particularly, the present invention relates to caps for closing fluid inlet ports and containing a collapsible funnel.

2. Prior Art

Devices for guiding fluids into hard to reach or small openings are well known. Typically a funnel is used to facilitate pouring a fluid into such an opening. The oil inlet port of an engine is such an opening, often being located in a hard to reach place. Furthermore, even if the inlet port is not hard to reach, the opening is usually small. Because the opening is small or in a difficult to reach location, attempting to pour oil without a guiding device may result in spillage around the inlet port and onto the engine. The spilled oil is difficult to clean up. Use of a funnel reduces the spilling of oil when pouring, but may not completely eliminate it. After pouring, oil will coat the inside of the funnel. When the funnel is removed oil may drip from it.

Continuing the example of an oil inlet port on a car engine, a funnel used to pour oil into the oil port must be stored after use. The funnel should be accessible when needed. Storing the funnel in a garage may be fine if oil is only added there, but if oil is to be added somewhere else the funnel must be stored in the car. Before storage the funnel must be cleaned or placed in a container. If it is stored without cleaning, the oil clinging to the funnel will gradually drain off the funnel onto the surface on which it is stored. There is also the problem of the funnel being misplaced or lost.

It would be highly advantageous, therefore, to remedy the foregoing and other deficiencies inherent in the prior art.

Accordingly, it is an object of the present invention to provide improvements in a fluid funnelling device.

Another object of the present invention is to provide a combination cap and telescoping funnel.

And another object of the present invention is to provide a funnel which is always present.

Still another object of the present invention is to provide a cap which allows easy access to an inlet port.

Yet another object of the present invention is to provide a funnel which does not require cleaning after use.

Yet still another object of the present invention is to provide a cap with a self contained funnel to eliminate storage problems.

SUMMARY OF THE INVENTION

Briefly, to achieve the desired objects of the instant invention in accordance with a preferred embodiment thereof, provided is a telescoping funnel having a plurality of sections which collapse concentrically into a base section. A stop means for preventing over extension of said telescoping funnel and cap attachment means coupled to said base section for coupling said section to a fluid inlet port. Further provided is a holding plug for closing the telescoping funnel holding the concentric sections in the collapsed position and sealing the fluid inlet port. The holding plug is attaching to the base section by plug attachment means.

BRIEF DESCRIPTION OF THE DRAWINGS

The foregoing and further and more specific objects and advantages of the instant invention will become readily apparent to those skilled in the art from the following detailed descriptions of preferred embodiments thereof taken in conjunction with the drawings, in which:

FIG. 6 is a top sectional view taken along lines 6—6 of FIG. 5;

FIG. 7 is a bottom sectional view taken along line 7—7 of FIG. 5;

FIG. 8 is a partial exploded view of the first embodiment of the present invention;

FIG. 9 is a partial side view illustrating a plug attachment means;

FIG. 10 is a partial side view illustrating an alternative cap attachment means;

FIG. 11 is a partial side view illustrating an alternative cap attachment means;

FIG. 12 is a partial side view illustrating a cap attachment adaptor;

DETAILED DESCRIPTION OF THE PREFERRED EMBODIMENT

Figure 1:
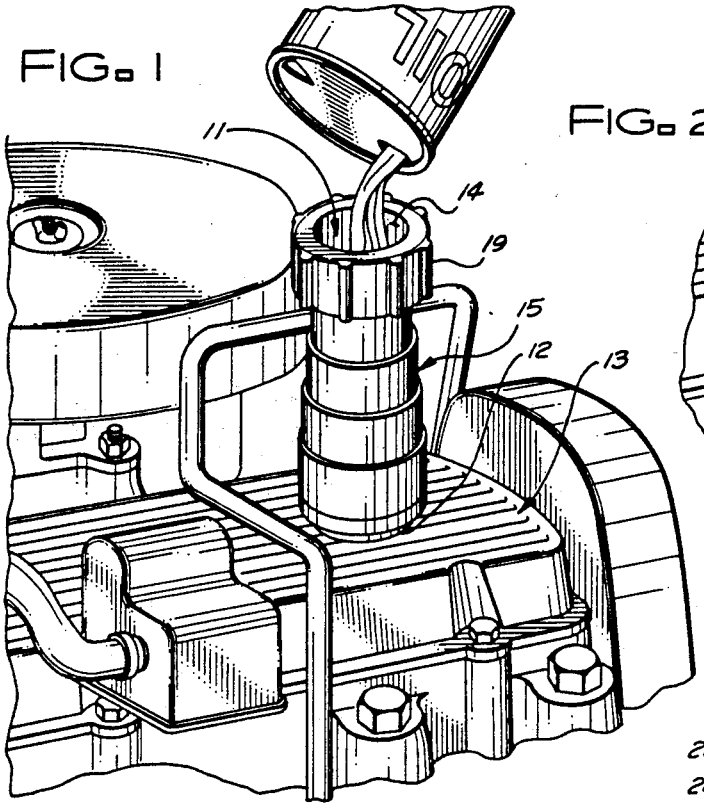
FIG. 1 is a perspective view of an extendable cap in accordance with the teachings of the present invention, as it would appear in the extended position without the holding plug and attached to the oil inlet port of a conventional engine.

Turning now to the drawings in which like reference characters indicate corresponding elements throughout the several views attention is first directed to FIG. 1 which illustrates an extendable cap generally designated 10 coupled to an oil inlet port 12 of an engine 13. FIG. 1 illustrates oil being poured into a funnel opening 14 of an extended telescoping funnel 15, which defines a fluid conduit 11, so as to be funnelled into oil inlet port 12 without spilling. As can be seen, telescoping funnel 15 of extendable cap 10 is extended up past various engine parts in order to be easily accessible.

Figure 2:
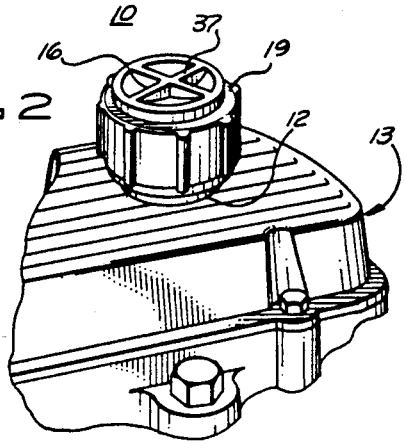
FIG. 2 is a perspective view of an extendable cap in the collapsed position with holding plug inserted as it would appear attached to the oil inlet port of a conventional engine.

FIG. 2 illustrates extendable cap 10 in its collapsed position, with a holding plug 16 closing funnel opening 14 and sealing oil inlet port 12. Holding plug 16 also holds telescoping funnel 15 in its collapsed position so extendable cap 10 can be easily removed from oil inlet port 12. FIG. 2 illustrates how collapsed extendable cap 10 takes up substantially no more room than a conventional cap, thus effectively storing a funnel that is not in the way and is always present when needed.

Figure 3:
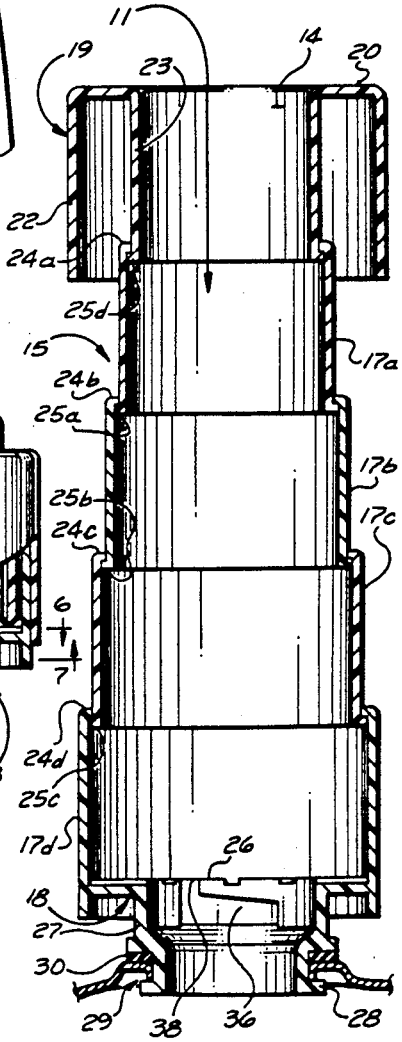
FIG. 3 is a sectional side view of a first embodiment of the present invention in the extended position.

FIG. 3 illustrates extendable cap 10, with holding plug 16 removed, in the extended position. Telescoping funnel 15, which extends extendable cap 10, consists of a plurality of cylindrical sections 17*a*, 17*b*, 17*c* and 17*d* with the lowermost, 17*d*, coupled to a base section 18 and an uppermost cover section 19. Because each section 17 is slightly smaller in diameter than the section below, when collapsed, sections 17*a*, 17*b* and 17*c* fit concentrically within 17*d* coupled to base section 18. Cover section 19 is a double walled cylinder with an outer portion 22 slightly larger in diameter than base 18, and an inner portion 23 slightly smaller in diameter than the topmost section 17*a*. Inner portion 23 and outer portion 22 are coupled by a top surface 20 extending perpendicularly between the top of inner portion 23 and outer portion 22. The bottom is left open to allow lower sections 17*a*, 17*b*, 17*c* and 17*d* to enter inside the double walled cover section 19 so that outer portion 22 of cover section 19 acts as a cover. This will be discussed in greater detail below.

In its extended position each section 17 of telescoping funnel 15 is prevented from being completely removed from the section below it by a stop means. In this embodiment, stop means is an inwardly turned lip 24*a*, 24*b*, 24*c* and 24*d* encircling the upper portion of each section 17*a*, 17*b*, 17*c* and 17*d* respectively, and an outwardly turned lip 25*a*, 25*b*, 25*c* and 25*d* on the lower portion of sections 17*a*, 17*b*, 17*c* and cover section 19 respectively. Cover section 19 does not require an inwardly turned lip on its upper portion, nor does section 17*d* require an outwardly turned lip on its lower portion. When fully extended, outward lips 25 and inward lips 24 meet, preventing further extension of telescoping funnel 15.

Still referring to FIG. 3, base section 18 has a base defining a lower opening 26 which is a continuation of fluid conduit 11. Lower opening 26 is extended downward by a neck 27 which corresponds to inlet port 12 to which cap 10 is to be attached. A cap attachment means is coupled to the lowermost portion of neck 27. In this embodiment, cap attachment means is a standard twist lock. Twist locks are well known to those skilled in the art, and can be seen clearly in FIG. 8. When extendable cap 10 is twisted, projections 28 on neck 27 cam down tightly in corresponding grooves 29 of oil inlet port 12. A tight seal is formed between a gasket 30 and oil inlet port 12. Those skilled in the art will understand that a variety of cap attachment means may be used, and some are discussed below. Inside the upper portion of neck 27 is a portion of plug attachment means. This will be discussed below.

Figure 4:
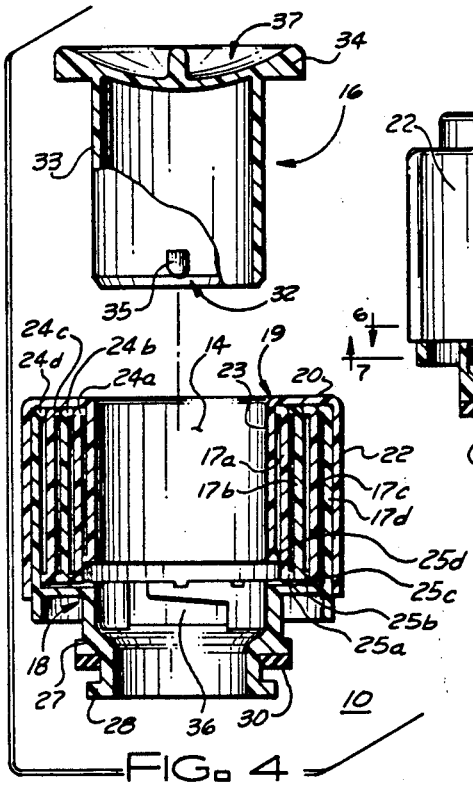
FIG. 4 is a sectional side view of a first embodiment of the present invention in the collapsed position with a holding plug.

Referring now to FIG. 4, extendable cap 10 is shown in the collapsed position. Sections 17*a*–17*c* can be seen nested concentrically within section 17*d*, with inner portion 23 of cover section 19 being innermost and outer portion 22 of cover section 19 being outermost. Holding plug 16, having a cylindrical body 33 and a flange 34 extending radially from the top surface thereof is inserted into funnel opening 14 and coupled to base section 18 by plug attachment means 32. In this embodiment plug attachment means 32 is a twist lock. A projection 35 extends from opposite sides of the lower portion of cylindrical body 33 and fit into corresponding grooves 36 in neck 27 of base section 18. This is a standard twist lock well known to those skilled in the art.

Figure 5:
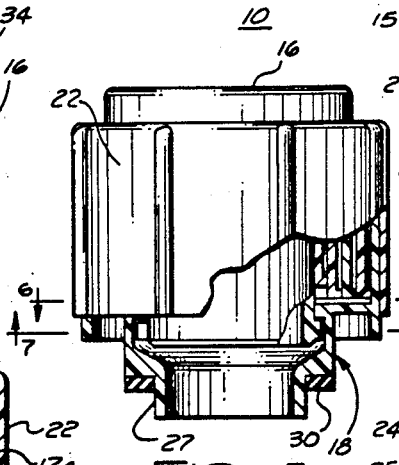
FIG. 5 is a partial sectional side view of the present invention in the collapsed position with the holding plug locked in place.

FIG. 6 shows a view looking down onto base section 18. Neck 27 is indented to either side forming grooves 36. Openings 38 allow entry of projections 35 of holding plug 16 to enter grooves 36. FIG. 7 shows holding plug 16 inserted and locked. FIG. 9 is a bottom view illustrating how once projections 35 have entered openings 38, twisting holding plug 16 causes projections 35 to move along grooves 36. The downward slop of the upper surface of grooves 36 pulls holding plug 16 firmly into funnel opening 14. When holding plug 16 is inserted and locked down, as illustrated in FIG. 5 flanges 34 rest upon top surface 20 of cover section 19. Thus telescoping funnel 15 is held in the collapsed position so that extendable cap 10 may be removed or replaced. Further, holding plug 16 closes funnel opening 14 and seals oil inlet port 12. Holding plug 16 also may have a grip 37 such as an inset grip illustrated in FIG. 2 and 8 to facilitate placement and removal.

Extendable cap 10 is equipped with drain means for allowing fluid, in this example oil, to drain off each of segments 17 and collect on base member 18. In FIGS. 6 and 8 a first drain means is shown. It consists of a plurality of radial channels 40 on the upper surface of base section 18. Radial channels 40 collect the oil draining from segments 17 and allow the collected oil to run into oil inlet port 12 when holding plug 16 is removed. Other means, such as beads on the bottom of each segment may be used and are discussed below.

Figure 13:
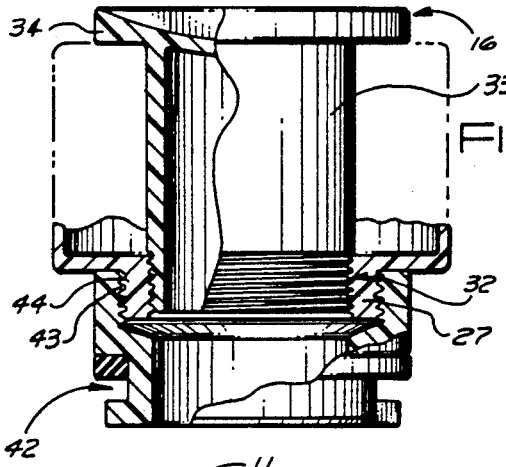
FIG. 13 is a sectional side view illustrating an alternative adaptor attachment means and an alternative plug attachment means.

Not all fluid inlet ports are identical, some require twist locks others are threaded. To allow extendable cap 10 to be used on all types, an adaptor may be used, or other attachment means may replace the twist lock FIGS. 10 and 11 illustrate two possible attachment means. FIG. 10 would be used for threaded fluid inlets and FIG. 11 for a plain push in attachment. These may also be used on adaptor fittings as illustrated in FIG. 12. In this embodiment the lower portion of neck 27 of base section 18 is missing. An adaptor 42 consisting of a cylinder slightly larger than neck 27 is coupled to neck 27 using adaptor attachment means such as a friction fit. The lower portion of adaptor 42 is a cap attachment means. In this figure a standard twist lock is shown. It will be understood by those skilled in the art that other ways of attaching adaptor 42 to base section 18 may be used, such as that illustrated in FIG. 13. In this embodiment, the outside of neck 17 has threads 43 which mate with threads 44 on the inside of adaptor 42.

Figure 14:
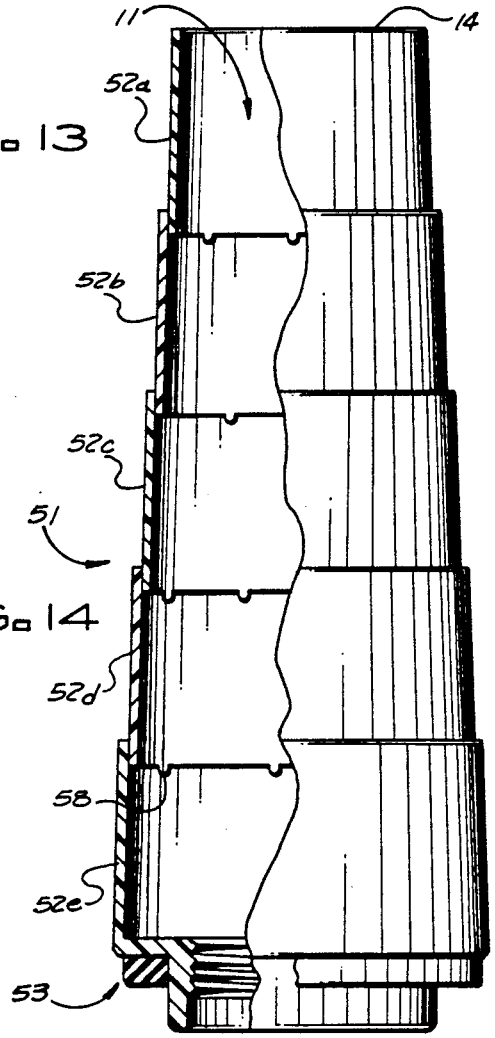
FIG. 14 is a partial sectional side view illustrating an alternative holding plug and the telescoping funnel in an extended position.
Figure 15:
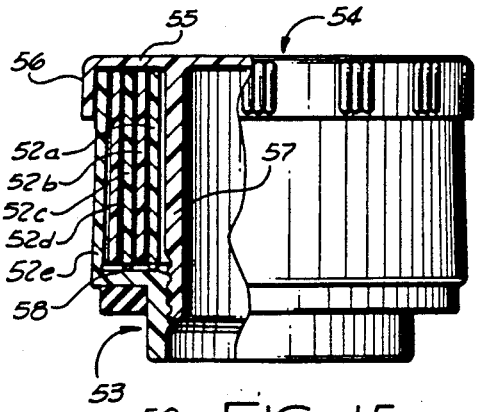
FIG. 15 is a partial sectional side view illustrating an alternative holding plug and the telescoping funnel illustrated in FIG. 14 in the collapsed position.

FIG. 14 illustrates a second embodiment, generally designated 50, of the present invention. In this embodiment five frusto-conical sections 52 are comprised a telescoping funnel 51 and collapse concentrically onto a base section 53. Lowermost section 52*e* is coupled to base section 53. In this embodiment stop means for preventing over extension of telescoping funnel 51 is the friction between the wide end of one section with the narrow end of another. Also, a holding plug 54 which operates similarly to holding plug 16 of the first embodiment has a cylindrical body 57 with an enlarged flange 55 extending outwardly from its upper portion, and has a cover portion 56 extending perpendicularly downward from flange 55 substantially parallel to cylindrical body 57. Holding plug 54 attaches to base section 53 by plug attachment means. This means may be similar to that in the first embodiment or threaded as illustrated in FIG. 15 It will be understood by those skilled in the art, that any of the embodiments described may use the attachment means interchangeably. Therefore the second embodiment may use a twist lock or the first embodiment may use threads. When holding plug 54 is attached to base section 53 frusto-conical sections 52 fit between cover portion 56 and cylindrical body 57 thus holding telescoping funnel 51 in the collapsed position.

Drain means is also used, and in this embodiment consists of beads 58 attached to the bottom of each section 52 *a–e*. When in the collapsed position beads 58 rest on base 53 and keep sections 52 off base 53. This allows fluid to drain off each section 52 and collect on base 53.

Figure 16:
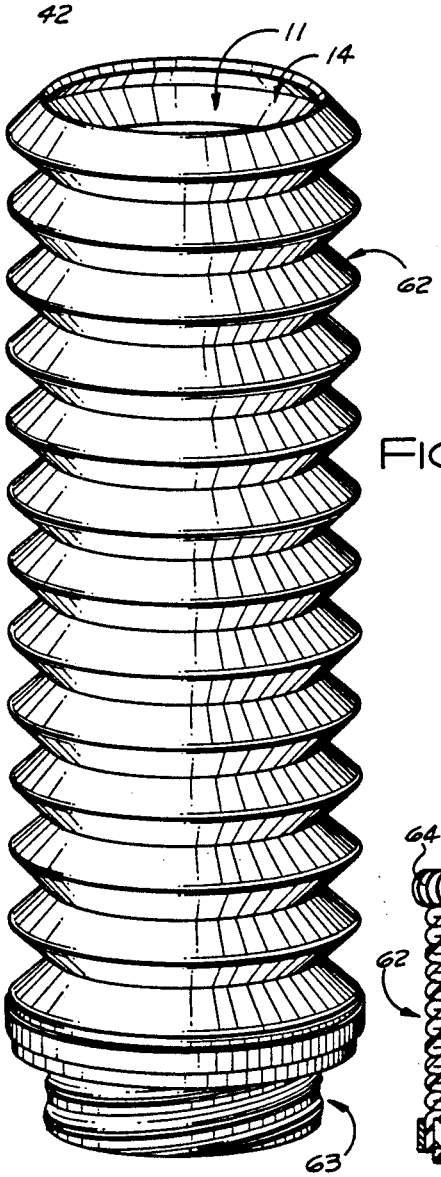
FIG. 16 is a perspective view of an alternative funnel in the extended position.
Figure 17:
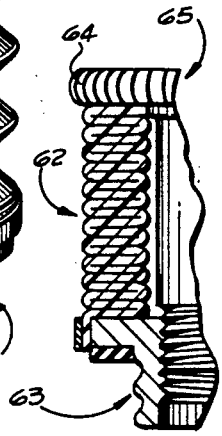
FIG. 17 is a partial sectional side view of FIG. 16 in a collapsed position.

FIG. 16 illustrates a third embodiment generally designated 60 in which a funnel 62 is a single piece which collapses accordion fashion. It has a base 63 similar to the base section of prior embodiments with funnel 62 attached thereto. In this embodiment funnel 62 is held in the collapsed position by a flange 64 extending outwardly from a holding plug 65 as illustrated in FIG. 17. This embodiment is similar to the other embodiments in all other ways.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An extendable cap for attachment to a fluid inlet port comprising:

a base member defining an opening, said base member having an upper surface;

a telescoping funnel defining a fluid conduit attached to said base member with said fluid conduit corresponding to said opening, said conduit having a top end and a bottom end;

closure means removably mounted in the top end of said fluid conduit for sealing said inlet port and holding said funnel in a collapsed position;

closure attachment means for attaching said closure means to said base member; and cap attachment means for attaching said base member to said fluid inlet port.

2. A device as claimed in claim 1, wherein said telescoping funnel further comprises:

a plurality of concentric annular sections including a lowermost section coupled to said base member and an uppermost section, said sections reducing in diameter from a maximum at said lowermost section to a minimum at said uppermost section, to allow said sections to nest one within the other on said base member when collapsed and interfit when extended, each of said sections including an upper end and a lower end; and stop means for preventing over extension of said telescoping funnel.

3. A device as claimed in claim 2 wherein said stop means is an outwardly turned lip on the lower end of each annular section and an inwardly turned lip on the upper end of each annular section.

4. A device as claimed in claim 2, wherein:

said annular sections are generally frustro-conical in shape; and said stop means comprises a frictional fit between said annular sections.

5. A device as claimed in claim 2 further comprising:

a cover section attached to the uppermost section of said telescoping funnel;

said cover section defines a funnel opening which gives access to said fluid conduit; and said cover section encloses said annular sections when collapsed and is held in place by said closure means.

6. A device as claimed in claim 2, further comprising drain means for allowing fluid to drain off said telescoping funnel.

7. A device as claimed in claim 1 wherein said telescoping funnel is an accordion type tube.

8. A device as claimed in claim 1 wherein said base member includes a neck extending downwards from around, and further defining said opening.

9. A device as claimed in claim 8, wherein said closure means further comprises:

a cylindrical body corresponding to said fluid conduit, said cylindrical body including an upper end and a lower portion;

a flange extending radially from said upper end of said cylindrical body; and a grip.

10. A device as claimed in claim 9 wherein said closure attachment means comprises:

threads in the lower portion of the outside of said cylindrical body; and threads inside the upper portion of said neck.

11. A device as claimed in claim 9 wherein said closure attachment means is a twist lock comprising projections on the lower portion of said cylindrical body; and grooves inside the upper portion of said neck corresponding to said projections.

12. A device as claimed in claim 9, further comprising a cover portion extending from said flange of said closure means to enclose said telescoping funnel in the collapsed position.

13. A device as claimed in claim 8 wherein said cap attachment means is a threaded attachment with threads on the outside of said neck which correspond to threads in said fluid inlet port.

14. A device as claimed in claim 8 wherein said cap attachment means is a bayonet lug at with bayonet projections on the outside of said neck which corresponds to said fluid inlet port.

15. A device as claimed in claim 8 wherein said cap attachment means may be removably coupled to said neck.

16. A device as claimed in claim 1, further comprising drain means for allowing fluid to drain off said telescoping funnel.

17. A device according to claim 16, wherein said drain means comprises a plurality of radial channels on the upper surface of said base member.

18. A device as claimed in claim 17, wherein:

the lower end of each of said annular sections includes a bottom edge; and said drain means comprises a plurality of small beads formed on the bottom edge of all but the lowermost of said sections.

19. An extendable cap for attachment to a fluid inlet port comprising:

a base member having
a base having an upper surface,
an opening defined by said base, and
a neck extending downward from said base corresponding to said opening;
a telescoping funnel attached to the upper surface of said base section having
a plurality of concentric annular sections including a lowermost section coupled to said base member and an uppermost section, said sections reducing in diameter from a maximum at said lowermost section to a minimum at said uppermost section, to allow said sections to nest inside each other on said base member when collapsed and interfit when extended, each of said sections including an upper end and a lower end,
stop means to prevent over extension of said annular sections, and
a fluid conduit defined by said concentric annular sections, said conduit having a top end a bottom end;
closure means removably mounted in the top end of said conduit for blocking said fluid conduit and holding said telescoping funnel in the collapsed position having
a cylindrical body corresponding to said fluid conduit, said cylindrical body including an upper end and a lower portion,
a flange extending radially from said upper end of said body, and
a grip;
closure attachment means for attaching said plug to said base member;
cap attachment means for attaching said base section to said fluid inlet port; and
drain means for allowing fluid to drain off said telescoping funnel.

20. A device as claimed in claim 19 wherein said stop means is an outwardly turned lip on the lower end of each annular section and an inwardly turned lip on the upper end of each annular section.

21. A device as claimed in claim 19, wherein:
said annular sections are generally frustro-conical in shape; and
said stop means comprises a frictional fit between said annular sections.

22. A device as claimed in claim 19 wherein said plug attachment means comprises:
threads in the lower portion of the outside of said cylindrical body; and
threads inside the upper portion of said neck.

23. A device as claimed in claim 19 wherein said closure attachment means is a twist lock comprising projections on the lower portion of said cylindrical body; and
grooves inside the upper portion of said neck corresponding to said projections.

24. A device as claimed in claim 19 wherein said cap attachment means is a threaded attachment with threads on the outside of said neck which correspond to threads in said fluid inlet port.

25. A device as claimed in claim 19 wherein said cap attachment means is a bayonet lug attachment with bayonet projections on the outside of said neck which corresponds to said fluid inlet port.

26. A device as claimed in claim 19 wherein said cap attachment means may be removably coupled to said neck.

27. A device as claimed in claim 19 further comprising:
a cover section attached to the uppermost section of said telescoping funnel;
said cover section defines a funnel opening which gives access to said fluid conduit; and
said cover section encloses said annular sections when collapsed and is held in place by said closure means.

28. A device as claimed in claim 19 wherein said drain means is a plurality of radial channel on the upper surface of said base.

29. A device as claimed in claim 19, wherein:
the lower end of each of said annular sections includes a bottom edge; and
said drain means comprises a plurality of small beads formed on the bottom edge of all but the lowermost of said sections.

* * * * *

UNITED STATES PATENT AND TRADEMARK OFFICE

CERTIFICATE OF CORRECTION

PATENT NO. : 5,033,521

DATED : July 23, 1991

INVENTOR(S) : Gregory A. Martin

It is certified that error appears in the above-identified patent and that said Letters Patent is hereby corrected as shown below:

In Column 5, line 11, change "a-e" to --a-d--.

Column 6, line 49:
In Claim 14, line 2, delete "at" and insert --attachment--.

Signed and Sealed this

Seventeenth Day of November, 1992

*Attest:*

DOUGLAS B. COMER

*Attesting Officer*

*Acting Commissioner of Patents and Trademarks*